US009198474B1

(12) United States Patent
Hacobian

(10) Patent No.: US 9,198,474 B1
(45) Date of Patent: Dec. 1, 2015

(54) SATURATION, CHEMICAL, AND IMPACT-RESISTANT PROTECTIVE GLOVE

(71) Applicant: Edwin Hacobian, Bakersfield, CA (US)

(72) Inventor: Edwin Hacobian, Bakersfield, CA (US)

( * ) Notice: Subject to any disclaimer, the term of this patent is extended or adjusted under 35 U.S.C. 154(b) by 288 days.

(21) Appl. No.: 13/781,650

(22) Filed: Feb. 28, 2013

Related U.S. Application Data

(60) Provisional application No. 61/605,135, filed on Feb. 29, 2012.

(51) Int. Cl.
*A41D 19/015* (2006.01)
*A41D 19/00* (2006.01)

(52) U.S. Cl.
CPC .... *A41D 19/01505* (2013.01); *A41D 19/01523* (2013.01); *A41D 19/0006* (2013.01); *A41D 19/0058* (2013.01)

(58) Field of Classification Search
CPC ..... A41D 19/0006; A41D 19/001; A41D 19/0058; A41D 19/015; A41D 19/01523; A41D 19/01505
USPC ..... 2/159, 160, 161.1, 161.3, 161.7, 161.8, 2/164, 166
See application file for complete search history.

(56) References Cited

U.S. PATENT DOCUMENTS 3,348,238 A * 10/1967 Hydock ..... 2/161.2
3,882,548 A * 5/1975 Shinagawa et al. ..... 2/20
3,918,096 A * 11/1975 Lim ..... 2/161.1
4,094,014 A * 6/1978 Schroeder ..... 2/161.8
D248,898 S * 8/1978 DeLeone et al. ..... D29/117.1
4,590,625 A * 5/1986 Keim ..... 2/161.3
D288,981 S * 3/1987 Hale ..... D29/123
4,757,555 A * 7/1988 Gold ..... 2/16
4,766,612 A * 8/1988 Patton, Sr. ..... 2/16
4,768,234 A * 9/1988 Yamamoto ..... 2/16
4,911,433 A * 3/1990 Walker et al. ..... 482/105
5,345,609 A * 9/1994 Fabry et al. ..... 2/20
5,537,692 A * 7/1996 Dorr ..... 2/161.1
5,608,912 A * 3/1997 Cumberland ..... 2/16
5,640,712 A * 6/1997 Hansen et al. ..... 2/20
5,809,571 A * 9/1998 Spitzer ..... 2/161.1
8,490,217 B2 * 7/2013 Safford ..... 2/161.6
2005/0091721 A1 * 5/2005 Best ..... 2/16
2006/0156451 A1 * 7/2006 Klein et al. ..... 2/159
2007/0074332 A1 * 4/2007 Wilder et al. ..... 2/161.1
2007/0083980 A1 * 4/2007 Yang et al. ..... 2/167
2007/0220653 A1 * 9/2007 Mack et al. ..... 2/159
2007/0245453 A1 * 10/2007 Dolenak ..... 2/161.6
2008/0078011 A1 * 4/2008 Kleinert ..... 2/161.1
2008/0209607 A1 * 9/2008 Kohler ..... 2/16
2008/0216209 A1 * 9/2008 Kim ..... 2/161.8
2008/0263738 A1 * 10/2008 Shamis et al. ..... 2/16
2008/0263747 A1 * 10/2008 DeBlasis et al. ..... 2/161.1
2009/0172865 A1 * 7/2009 Murphy ..... 2/163
2009/0229035 A1 * 9/2009 Van Hale ..... 2/161.6

(Continued)

*Primary Examiner* — Khaled Annis
(74) *Attorney, Agent, or Firm* — R. Scott Kimsey; Klein DeNatale Goldner, LLP

(57) ABSTRACT

A protective glove has an inner liner, an intermediate protective layer, and an outer saturation-proof layer. The inner layer defines fingers, a thumb, and a central opening to receive the hand of a user of the glove. The intermediate protective layer includes an impact-resistant material atop at least a portion of the fingers, thumb, and central opening of the inner layer. The saturation-proof layer prevents liquids from passing through the glove. The impact-resistant material is compressible to allow flexing of the fingers of the glove when in use.

8 Claims, 6 Drawing Sheets

(56) References Cited

U.S. PATENT DOCUMENTS

| | | | | |
|---|---|---|---|---|
| 2009/0255032 | A1* | 10/2009 | Pugh | 2/161.1 |
| 2009/0281470 | A1* | 11/2009 | Sandusky et al. | 602/5 |
| 2009/0307821 | A1* | 12/2009 | Chang | 2/21 |
| 2010/0132087 | A1* | 6/2010 | Gait | 2/16 |
| 2010/0175162 | A1* | 7/2010 | Kleinert | 2/161.1 |
| 2011/0088139 | A1* | 4/2011 | Travell | 2/161.1 |
| 2011/0107498 | A1* | 5/2011 | Chang | 2/163 |
| 2012/0054942 | A1* | 3/2012 | Kim et al. | 2/161.1 |
| 2012/0090075 | A1* | 4/2012 | Piesker et al. | 2/168 |
| 2012/0266357 | A1* | 10/2012 | Nix et al. | 2/161.1 |

* cited by examiner

SATURATION, CHEMICAL, AND IMPACT-RESISTANT PROTECTIVE GLOVE

RELATED APPLICATIONS

This application claims priority of U.S. Provisional Patent Application No. 61/605,135, filed Feb. 29, 2012 and entitled "Method for Making Impact Hand Covering." This Provisional patent application is incorporated herein by reference in its entirety.

BACKGROUND OF THE INVENTION

1. Field of the Invention

The present invention relates generally to the field of protective gloves, and more particularly to an impact-resistant protective glove that is also resistant to chemicals and to saturation.

2. Background

Hand injuries account for a substantial number of all workplace injuries, particularly in industries where workers use heavy equipment and materials, or work with hazardous tools and chemicals. Wrist, finger, and hand injuries account for 19% or more of all serious injury claims in oilfield, construction, and other such environments. The need to protect worker's hands in these environments is ongoing and substantial.

Protective gloves are known in the art. Some such gloves are constructed from materials that protect a user's hands from exposure to water or other chemicals. Some gloves include protective ridges or other structures on the outer surface of the glove to protect against the force of impact.

Although there is a great need in the art for a glove that protects against saturation, as well as impact, while remaining a viable choice for workers, known gloves have been unable to meet this long-standing need. Gloves with rigid impact-resistant structures affixed to the exterior are often constructed of soft, flexible material so that the worker can flex his fingers and continue to manipulate the glove as required on a job site. These gloves are not resistant to water and other chemicals, and will become saturated when used in such environments. Gloves that are resistant to water or other chemicals do not provide adequate resistance to impact. A worker may typically switch between a variety of gloves, choosing that glove which provides the best protection for a given work environment and sacrificing protections that the glove does not provide.

What is needed, then, is a glove that is impact resistant, flexible, and provides protection against saturation by water or other chemicals.

SUMMARY OF THE INVENTION

The present invention provides a protective glove having an inner liner, an intermediate protective layer, and an outer saturation-proof layer. The inner layer defines fingers, a thumb, and a central opening to receive the hand of a user of the glove. The intermediate protective layer includes an impact-resistant material atop at least a portion of the fingers, thumb, and central opening of the inner layer. The saturation-proof layer prevents liquids from passing through the glove. The impact-resistant material is compressible to allow flexing of the fingers of the glove when in use.

In another aspect of the invention the intermediate protective layer has a first portion with a first thickness and a plurality of second portions with a second thickness. The first thickness is less than the second thickness. The plurality of second portions are spaced apart to allow flexing of the protective glove when in use.

In another aspect of the invention, the inner liner includes a pocket defined along an upper surface of the inner liner. The pocket is sized and shaped to receive the impact-resistant material that forms the protective layer.

In another aspect of the invention, the pocket defined along the upper surface of the inner liner is a first pocket. The first pocket extends across a portion of the inner lining defining the fingers and the central opening. The glove also includes a second pocket along an upper portion of the inner lining defining the thumb. The second pocket is sized and shaped to receive a second portion of the impact-resistant material.

In another aspect of the invention, the outer, saturation-proof layer is polyvinyl chloride, latex, nitrile, vinyl, and combinations thereof.

In another aspect of the invention, the impact-resistant material is ethylene vinyl acetate.

In another aspect of the invention, the glove includes a cuff defining a perimeter of the protective glove through which a user inserts his hand.

In another aspect of the invention, the protective glove includes an inner liner defining a plurality of fingers, a thumb, and a central opening to receive a user's hand, a saturation-proof layer covering the inner lining for preventing liquids from passing through the glove having an external surface facing away from the hand of the wearer when the glove is worn, the external surface has a smooth and continuous profile as shown in FIGS. 1-2, and impact-resistant member attached to the glove at the upper surface of the inner liner or an upper surface of the saturation-proof layer.

In another aspect of the invention, the impact-resistant member is attached to the upper surface of the saturation-proof layer.

DETAILED DESCRIPTION OF THE INVENTION

Figure 1:
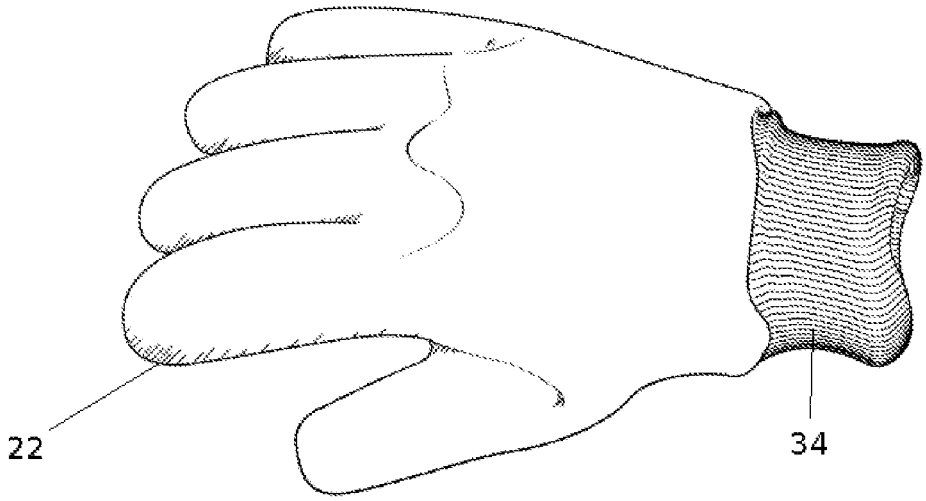
FIG. 1 is a top perspective view of one embodiment of an impact and saturation-resistant glove according to the present invention.
Figure 2:
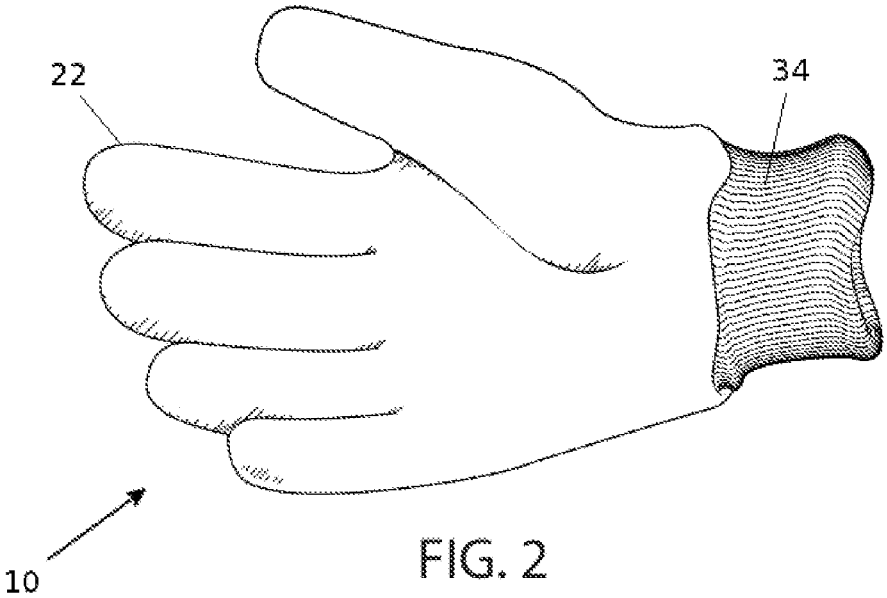
FIG. 2 is a bottom perspective view of one embodiment of an impact and saturation-resistant glove according to the present invention.

Turning to the drawings, wherein like numerals indicate like parts, the numeral 10 refers generally to a protective glove of the present invention. In one embodiment of the invention, protective glove 10 includes an inner lining 12, impact-resistant insert 18 and 19, and outer layer 22 coextensive with the inner lining 12. In some embodiments of the invention, inner liner 12 may be composed of a top liner panel 14 and a bottom liner panel 16. Further, some embodiments of the invention may make use of pockets 20 and 38 to house impact-resistant inserts 18 and 19. FIGS. 1 and 2 show external views of a top and bottom, respectively, of completed gloves of one embodiment of the present invention, with cuffs 34 (described further below) included.

Figure 4:
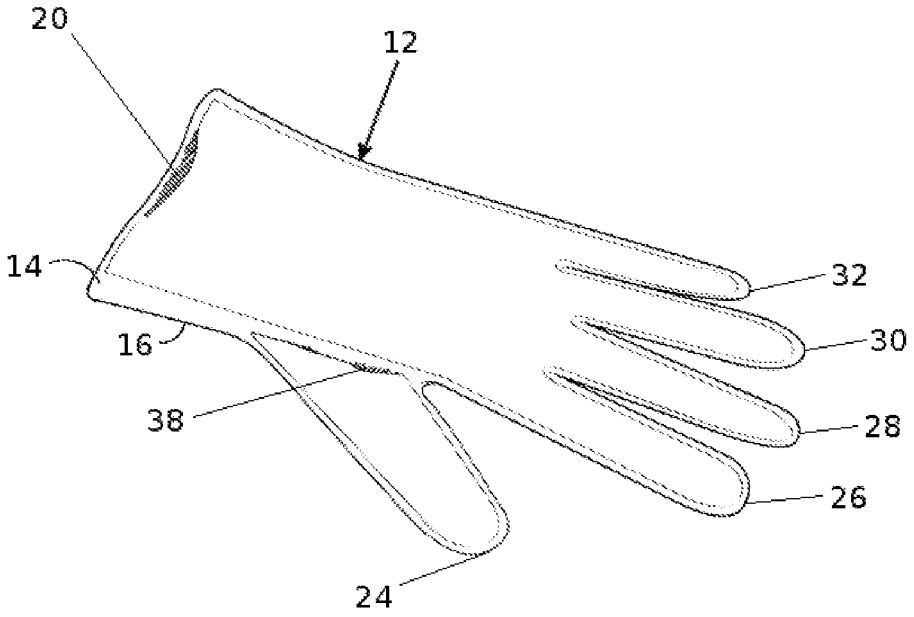
FIG. 4 is a top perspective view of one embodiment of an inner liner according to the present invention.
Figure 5:
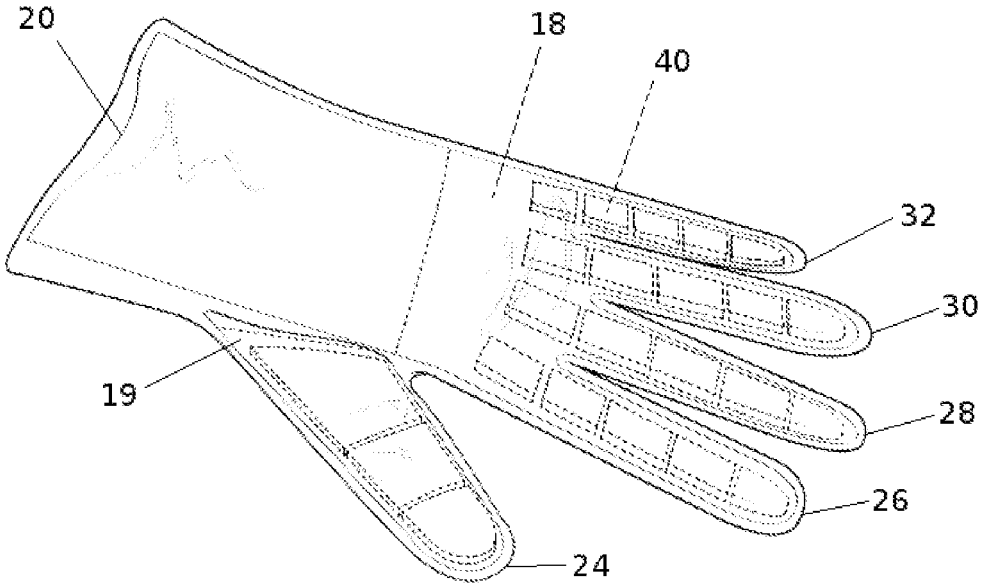
FIG. 5 is a top perspective view of one embodiment of an inner liner according to the present invention with impact-resistant inserts inserted therein.

Inner liner 12 is preferably constructed of a soft material that allows a user to easily slip on and off a glove of the present invention. Exemplary materials include cotton, wool, polyester, fleece, and flock. The liner may also be constructed of blends of material. In some embodiments of the invention, wherein the gloves are also intended to provide at least some insulation from the cold, various insulating materials such as Gore-tex® or 3M™ Thinsulate™ may also be provided in the inner liner. Although the inner liner may be provided as a unitary construction, it is contemplated that in some embodiments of the invention, inner liner 12 will be comprised of a top panel 14 and a bottom panel 16. The top panel 14 covers the back of the hand and fingers, while the bottom panel 16 is opposed to the top panel 14 and covers the palm of the hand and the bottom of the fingers. The two panels are sewn together or otherwise joined to form the inner liner 12 of the glove. As shown in FIG. 4, inner liner 12 defines a thumb 24 and four fingers—the index finger 26 and three remaining fingers 28, 30, and 32.

Figure 3:
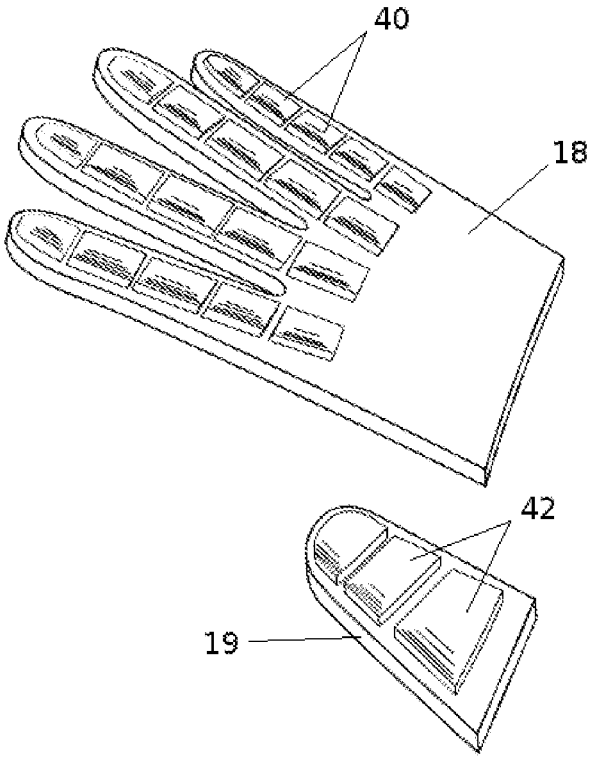
FIG. 3 is a perspective of one embodiment of impact-resistant inserts according to the present invention.

Impact-resistant inserts 18 and 19 form an intermediate layer of glove 10, as shown in one embodiment in FIG. 3. In a preferred embodiment of the invention, both impact resistant inserts 18 and 19 are used. It is contemplated, however, that a single impact-resistant insert may be used to cover the entire hand, or that more than two impact-resistant inserts may be used. In some embodiments of the invention, for example, each finger may have a separate impact-resistant insert associated therewith, and separate impact-resistant inserts may be used to protect the thumb and the top of the hand. In the embodiment of the invention shown in the drawings, impact resistant insert 18 covers the top of the user's hand and four fingers, being positioned atop the respective portion of top panel 14. Impact resistant insert 19 is positioned over the top of thumb 24 and serves to protect the thumb from impact. Using a separate impact-resistant insert 19 to cover the thumb provides the user of the glove with a wider range of flexibility for the thumb.

Impact-resistant inserts 18 and 19 may be constructed of any suitable impact-resistant material, provided that the material be compressible to allow for flexing of the fingers by a user of the present glove. Compressibility of impact-resistant inserts 18 and 19 is important because in some embodiments of the present invention, the outer layer 22 is constructed from a material that has little or no stretchability, and flexation of the fingers by the user depends on the compressible nature of the impact-resistant inserts. Use of a compressible impact-resistant insert allows the present glove to overcome a long-standing problem in the art—namely, the provision of a glove that is both impact-resistant and allows a broad range of flexibility in the fingers of the user. Any suitable material may be used to construct impact-resistant inserts 18 and 19. An exemplary material is ethylene vinyl acetate (EVA). Other materials suitable for various embodiments of the invention include urethane, sponge, air-gel, various liquids, and cellulose material. Impact-resistant inserts 18 and 19 may also be constructed from a combination of materials. When impact-resistant members are placed on the outside of a glove, as described in greater detail, below, the impact-resistant members are preferably constructed from a durable, wear-resistant material.

Impact-resistant inserts 18 and 19 may be adhered to the outer surface of top panel 14 of inner liner 12 using any suitable adhesive. It is preferred, however, that pockets 20 and 38 are utilized, and that impact-resistant inserts 18 and 19 are sown into pockets 20 and 38, respectively. Use of pockets 20 and 38 provides for the secure positioning of impact-resistant inserts 18 and 19 over the hand of a user of the present glove, without risk that an adhesive substance will fail and allow impact-resistant inserts 18 and 19 to become misaligned within the interior of glove 10.

Outer layer 22 of protective glove 10 provides protection against saturation by water or other chemicals. The material used to construct outer layer 22 may vary, depending on the use for a given glove. An exemplary protective glove 10 comprises an outer layer constructed from polyvinyl chloride. Other exemplary materials that may be used include nitrile, vinyl, latex, and polyurethane. Outer layer 22 may also be constructed from blends or combinations of materials.

Construction of the present glove preferably occurs in a series of steps, with construction of inner liner 12 taking place first, followed by addition of impact-resistant inserts 18 and 19, and finally dipping of the inner liner and impact-resistant portions into the material that forms outer layer 22. Construction of one exemplary embodiment of the present glove is now provided.

Example 1

Inner liner 12 of the glove is constructed first, using cotton cloth. Methods for making such an inner liner are known in the art and are not described in detail here. One inner liner 12 is constructed, material is provided to construct pockets 20 and 38. This material is preferably the same materials used to construct inner liner 12 generally. The material is cut into the shapes required to define pockets 20 and 38, as shown in the drawings, with the material for pocket 20 corresponding to the portion of top panel 12 that covers the top of the hand, as well as to those portions that cover index finger 26 and remaining fingers 28, 30, and 32. The material is then partially sewn onto the top of inner lining 20, leaving open sufficient space for insertion of impact-resistant insert 18. Once impact-resistant 18 is inserted, pocket 20 can be sewn partially or entirely around the perimeter thereof. Likewise, with respect to pocket 38, a portion of material to be used to form the pocket is cut into a shape that conforms to an area of inner lining 12 that covers the thumb of a user of the present glove. This material is partially sewn onto inner lining 12, leaving open enough material to allow insertion of impact-resistant insert 19. Once impact-resistant insert 19 has been inserted into pocket 38, pocket 38 can be sewn partially or entirely to inner liner 12 around a perimeter of pocket 38.

Once inner liner 12 and the intermediate layer formed from impact-resistant inserts 18 and 19 are complete, the completed unit is dipped into the material for forming outer layer 22 (in this case, PVC). The glove is then baked in an oven at approximately 200 to 220 degrees centigrade for twenty minutes, in order to allow the PVC to cure. After curing, a saturation and chemical-proof, impact-resistant glove is obtained.

After completion of the glove, additional features may be added as desired by the manufacturer or user thereof. For example, cuff 34 may be sewn onto a protective glove 10 to provide a close fit around the wrist of a worker, preventing liquids or other materials from entering the glove at the wrist of the user.

Figure 7:
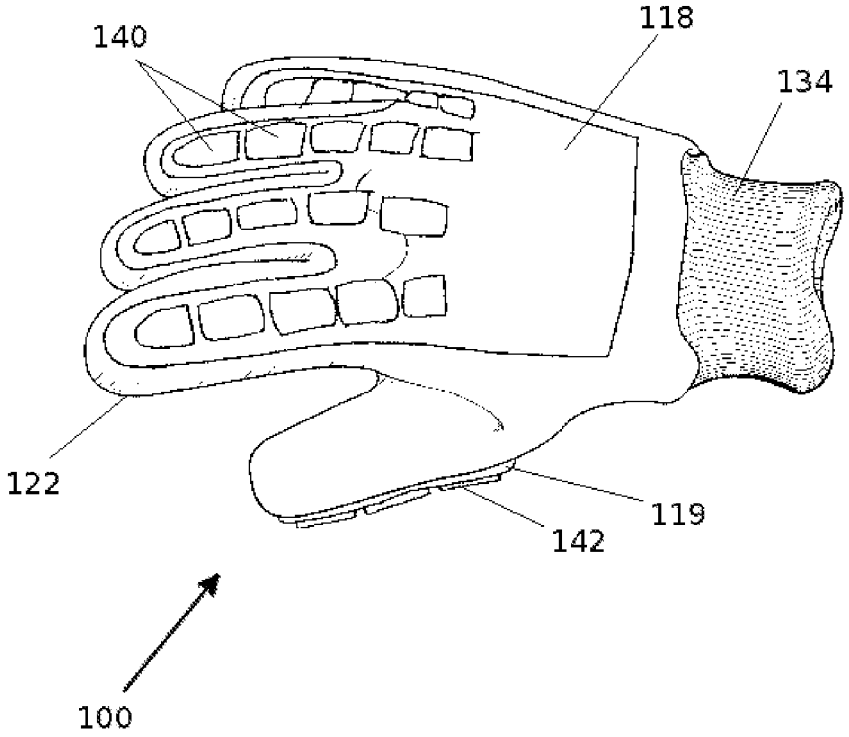
FIG. 7 is a top perspective view of one alternate embodiment of an impact and saturation-resistant glove according to the present invention.

In some embodiments of the present invention, impact-resistant members may be adhered to the outer surface of a glove as shown in FIG. 7. As shown in that Figure, protective glove 100 includes an outer surface 122 of saturation-proof material (such as, for example, PVC as described above). An impact-resistant member 118 is adhered to the support surface of protective glove 100, covering the top of the hand and fingers. Impact-resistant member 119 covers the thumb. As can be seen from the Figure, impact-resistant member 118 preferably includes raised portions 140, while impact-resistant member 119 preferably includes raised portions 142. Raised portions 140 provide greater impact-resistance, while the thinner portions of impact-resistant member 118 allow the user of protective glove 100 to flex his fingers or grasp items while using protective glove 100. Any suitable material may be used to construct impact-resistant members 118 and 119. Because impact-resistant members are situated on the outside of protective glove 100, it is preferred that wear-resistant, durable materials are used. Such materials may include, for example, neoprene or various rubberized materials. Likewise, any suitable material may be used for outer layer 122, including those materials described above with respect to other embodiments of the invention.

Figure 6:
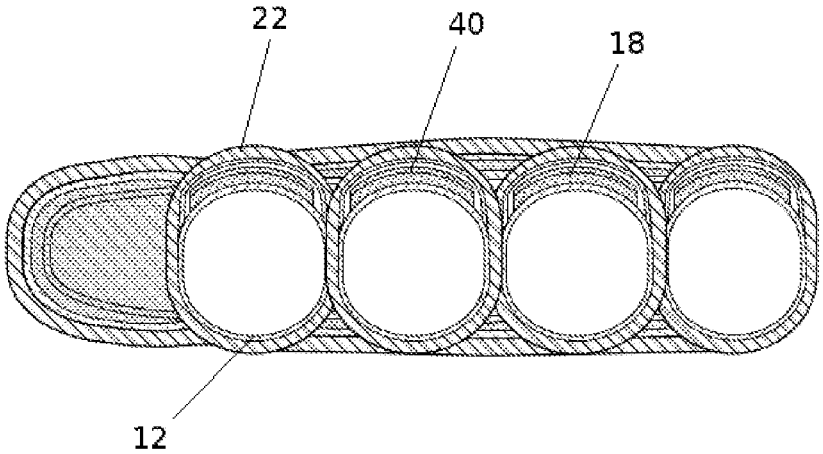
FIG. 6 is a cross-section view of one embodiment of an impact and saturation-resistant glove according to the present invention.

Similar to the above, and as shown in FIG. 3, inserts 18 and 19 include raised portions 40 and 42, respectively. Raised portions 40 and 42 have a thickness greater than the remaining portions of inserts 18 and 19, as shown, for example, in FIGS. 3 and 6.

Having thus described the preferred embodiment of the invention, what is claimed as new and desired to be protected by Letters Patent includes the following:

1. A protective glove comprising:

an inner liner defining a dorsal portion, a palm portion, fingers, a thumb, and a central opening to receive the hand of a user therein;

an intermediate protective layer comprising an impact-resistant material positioned atop at least a portion of the fingers, thumb, and central opening defined by the inner liner; and an outer, saturation-proof layer coextensive with the inner liner for preventing liquids from passing through the glove having an external surface facing away the hand of the wearer when the glove is worn, wherein the impact-resistant material is compressible to allow flexing of the fingers of the glove when in use, and further wherein the entire external surface of said outer, saturation-proof layer provides said glove with a smooth continuous external profile; wherein said intermediate protective layer comprises a plurality of raised portions, the raised portions having a thickness greater than a remainder of the intermediate protective layer, the plurality of raised portions being spaced apart to allow flexing of the protective glove when in use.

2. The protective glove according to claim 1, wherein the inner liner comprises a pocket defined along an upper surface thereof, the pocket sized and shaped to receive the impact-resistant material forming the intermediate protective layer.

3. The protective glove according to claim 2, wherein the pocket defined along an upper surface of the inner liner is a first pocket, the first pocket extending across a portion of the inner liner defining fingers and the central opening and sized and shaped to receive a first portion of the impact-resistant material, and further comprising a second pocket defined along a portion of the upper surface of the inner liner defining the thumb, the second pocket sized and shaped to receive a second portion of the impact-resistant material.

4. The protective glove according to claim 3, wherein the outer, saturation-proof layer comprises a material selected from the group consisting of polyvinyl chloride, latex, nitrile, vinyl, and combinations thereof.

5. The protective glove according to claim 4, wherein the impact-resistant material comprises ethylene vinyl acetate.

6. The protective glove according to claim 1, further comprising a cuff defining a perimeter of the protective glove configured to receive a user's hand therethrough when said glove is in use.

7. A protective glove comprising:

an inner liner defining fingers, a thumb, and a central opening to receive the hand of a user therein and having a pocket defined along an upper surface thereof;

an impact-resistant insert positioned within the pocket on the upper surface of the inner liner; and an outer, saturation-proof layer coextensive with the inner liner for preventing liquids from passing through the glove having an external surface facing away the hand of the wearer when the glove is worn, wherein the impact-resistant insert is compressible to allow flexing of the glove when in use, and further wherein the entire external surface of said outer, saturation-proof coating provides said glove with a smooth continuous external profile; wherein said intermediate protective layer comprises a plurality of raised portions, the raised portions having a thickness greater than a remainder of the intermediate protective layer, the plurality of raised portions being spaced apart to allow flexing of the protective glove when in use.

8. The protective glove according to claim 7, wherein the impact-resistant insert is a first impact-resistant insert sized and shaped to protect an upper surface of a user's hand and fingers when the protective glove is in use, further comprising a second impact-resistant insert positioned within said pocket, the second impact-resistant insert sized and shaped to protect an upper surface of a user's thumb when the protective glove is in use.

* * * * *